US007775455B2

(12) United States Patent
Kawai

(10) Patent No.: US 7,775,455 B2
(45) **Date of Patent: *Aug. 17, 2010**

(54) RAILWAY RAIL SUPPORTING PAD

(75) Inventor: Shoji Kawai, Nagoya (JP)

(73) Assignee: Daiwa Gravure Co., Ltd., Aichi (JP)

( * ) Notice: Subject to any disclaimer, the term of this patent is extended or adjusted under 35 U.S.C. 154(b) by 236 days.

This patent is subject to a terminal disclaimer.

(21) Appl. No.: 11/701,189

(22) Filed: Feb. 1, 2007

(65) Prior Publication Data

US 2008/0116291 A1 May 22, 2008

(30) Foreign Application Priority Data

Nov. 20, 2006 (JP) ..... 2006-312317

(51) Int. Cl.
*E01B 19/00* (2006.01)

(52) U.S. Cl. ..... 238/382; 238/283

(58) Field of Classification Search ..... 238/209, 238/287, 299, 306, 382
See application file for complete search history.

(56) References Cited

U.S. PATENT DOCUMENTS 4,462,224 A * 7/1984 Dunshee et al. ..... 62/530
5,494,190 A * 2/1996 Boettcher ..... 222/1
6,186,998 B1 * 2/2001 Inuzuka et al. ..... 604/410
6,491,159 B2 12/2002 Shibata
7,293,646 B2 * 11/2007 Masuda et al. ..... 206/219

* cited by examiner

*Primary Examiner*—S. Joseph Morano
*Assistant Examiner*—Robert J McCarry, Jr.
(74) *Attorney, Agent, or Firm*—Fildes & Outland, P.C.

(57) ABSTRACT

An object of the invention is to provide a railway rail supporting pad that allows easy operations at a field site. In the invention, there is provided an outer bag made of a synthetic resin sheet housing a first inner bag and a second inner bag, the first inner bag containing a first reaction solution, the second inner bag containing a second reaction solution, the first and the second inner bags being configured to open at least partly due to outer pressure, the outer bag being provided with a separable sub bag in a communicative manner, an inlet of the sub bag as a communication part between the outer bag and the sub bag being closed by an easily debondable sealed portion, an interior of the sub bag being formed with a plurality of partitioning spaces partitioned by another easily debondable sealed portion.

4 Claims, 10 Drawing Sheets

RAILWAY RAIL SUPPORTING PAD

BACKGROUND OF THE INVENTION

1. Field of the Invention

The present invention relates to a railway rail supporting pad to be interposed between a rail and a rail bearing member in a railway track for supporting the rail.

2. Description of the Related Art

Conventionally, as such a type of railway rail supporting pad, a pad to be interposed between a rail and a rail bearing member as disclosed, for example, in Japanese Unexamined Patent Publication No. 2004-84467 has been known. That is, such a railway rail supporting pad has, at one corner of a bag body, an injection port for injecting fluid and ambient temperature-setting resin, an exhaust port provided at a corner of the bag body diagonal to the injection port, and when a resin is injected into the bag body through the injection port, an interior air of the bag body is discharged through the exhaust port, and an excess resin in the bag body is discharged through the exhaust port.

Generally, such a railway rail supporting pad is mounted on a rail bearing member, and receives a rail mounted on a rubber pad mounted on the railway rail supporting pad. The railway rail supporting pad and the rubber pad are arranged at appropriate intervals in a longitudinal direction of the rail. A bag-like railway rail supporting pad is arranged so as to be interposed between the rail bearing member and the rubber pad, the rail is mounted on the rubber pad, and adhesivity of the rail with respect to the rail bearing member is adjusted by resin injected into the bag-like railway rail supporting pad.

According to the railway rail supporting pad disclosed in Japanese Unexamined Patent Publication No. 2004-84467, operation of injecting resin from the injection port into the bag body should be conducted at a field site, so that there arises a problem of labor of this operation, and another problem of soiling a periphery when injecting the resin into the bag body from the injection port and when discharging excess resin in the bag body from the exhaust port.

SUMMARY OF THE INVENTION

The present invention solves the aforementioned problems, and it is an object of the present invention to provide a railway rail supporting pad which eliminates necessity of injecting resin at a field site, causes no soiling a periphery with the resin at the field site, and allows easy operation at the field site.

In order to achieve the object, the present invention is featured as follows:

1. A railway rail supporting pad to be interposed between a rail bearing member and a rail, wherein an outer bag made of a synthetic resin sheet contains a first reaction solution as a base material and a second reaction solution as a curing agent so that the first reaction solution and the second reaction solution are mixed together due to external pressure from outside the outer bag, the outer bag is provided with a separable sub bag in a communicative manner, an inlet of the sub bag as a communication part between the outer bag and the sub bag is closed by an easily debondable sealed portion, and an interior of the sub bag is formed with a plurality of partitioning spaces each partitioned by another easily debondable sealed portion.

2. The railway rail supporting pad according to 1, wherein inside the outer bag, there is provided an inner bag made of the synthetic resin sheet so that at least a part thereof opens due to external pressure, the outer bag contains one of the first reaction solution as the base material and the second reaction solution as the curing agent, and the inner bag provided inside the outer bag contains one of the second reaction solution as the curing agent and the first reaction solution as the base material.

3. The railway rail supporting pad according to 1, wherein inside the outer bag, there are provided a first inner bag and a second inner bag each made of the synthetic resin sheet so that at least a part thereof opens due to external pressure, the first inner bag contains the first reaction solution as the base material and the second inner bag contains the second reaction solution as the curing agent.

According to the above configurations of the railway rail supporting pad, a mixture of the first reaction solution and the second reaction solution mixed in the outer bag due to external pressure from outside the outer bag can be cured, redundant compounds of the first reaction solution and the second reaction solution can be introduced to the sub bag, and the sub bag can be easily removed from the outer bag. This eliminates the necessity of injecting the resin at the field site as in the conventional technique, and causes no soiling the periphery with the resin at the field site, and allows easy operation at the field site. Further, since the plurality of partitioning spaces each partitioned by the easily debondable sealed portion are formed in the sub bag, when a load of rail is applied on the railway rail supporting pad, the railway rail supporting pad is strongly pressed, and the redundant compounds of the first reaction solution and the second reaction solution tend to flow into the sub bag as a surplus. At this time, pressure of the redundant compounds of the first reaction solution and the second reaction solution applied on the sealed portion partitioning each partitioning space causes the sealed portion to open, the redundant compounds of the first reaction solution and the second reaction solution sequentially push to open the partitioning spaces to enter therein, and finally are removed from the outer bag.

DESCRIPTION OF THE PREFERRED EMBODIMENTS

FIGS. 1 to 10 show a first embodiment of the present invention.

FIGS. 1 to 10 illustrate an outer bag 1, a first inner bag 2 having substantially the same size with the inner dimension of the outer bag 1 and housed in the outer bag 1, and a second inner bag 3 smaller than the first inner bag 2 and also housed in the outer bag 1. These outer bag 1, first inner bag 2, and second inner bag 3 are each made of a synthetic resin sheet.

Each of these outer bag 1, first inner bag 2, and second inner bag 3 has a rectangular, more specifically an oblong planar shape, when it is laid on a table or the like, and formed by four-side sealing. Among these outer bag 1, first inner bag 2, and second inner bag 3, the outer bag 1 is made of a commonly used sheet material including an inner layer made of a film material having a low melting point such as polyethylene, and an outer layer made of a film material having a higher melting point than that of the inner layer such as nylon, and formed by heat sealing the inner layers of the two sheet materials at their four sides.

Figure 1:
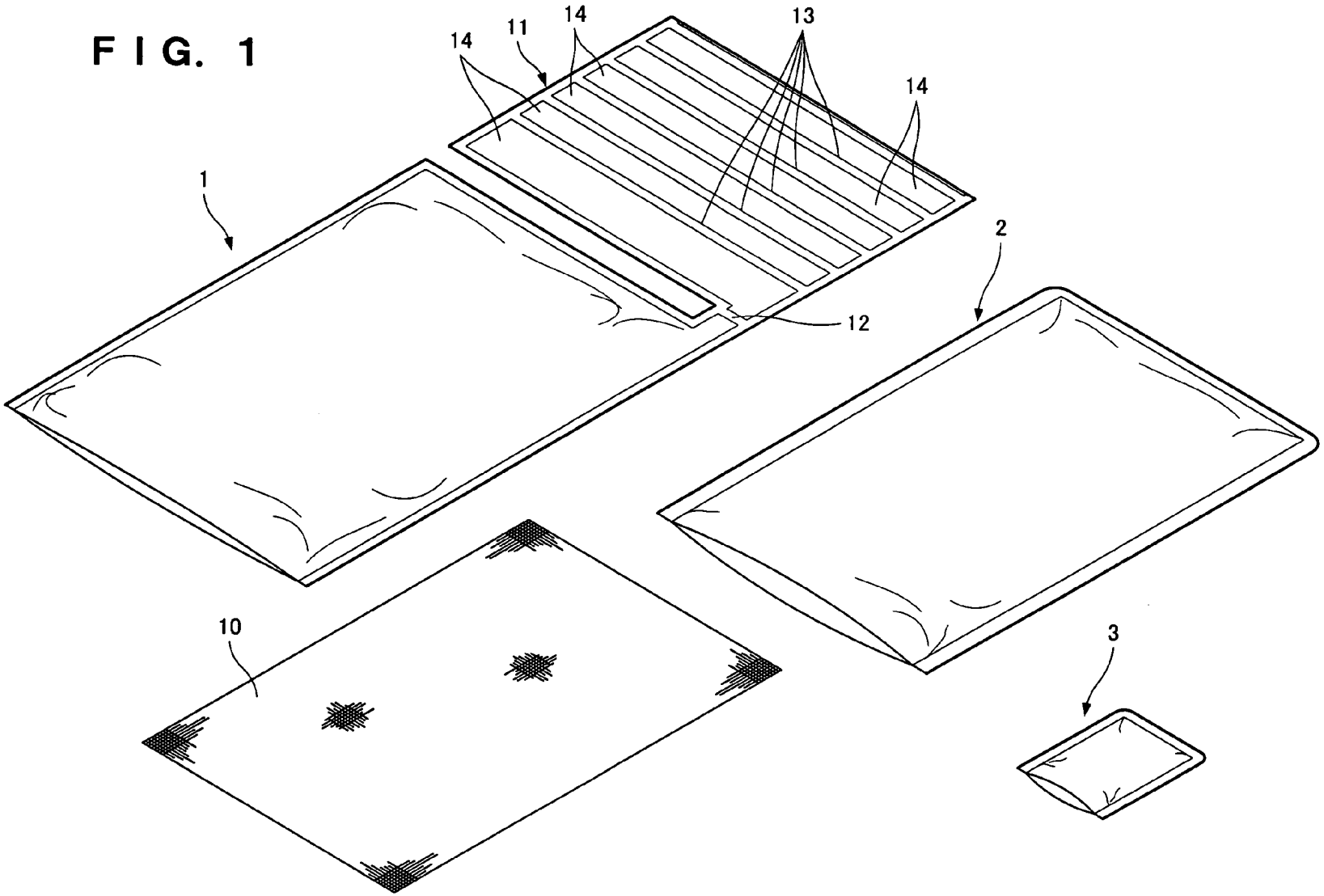
FIG. 1 shows exploded perspective views of an outer bag, a first inner bag, a second inner bag, and a glass fiber cloth constituting a railway rail supporting pad in a first embodiment of the present invention.
Figure 2A:
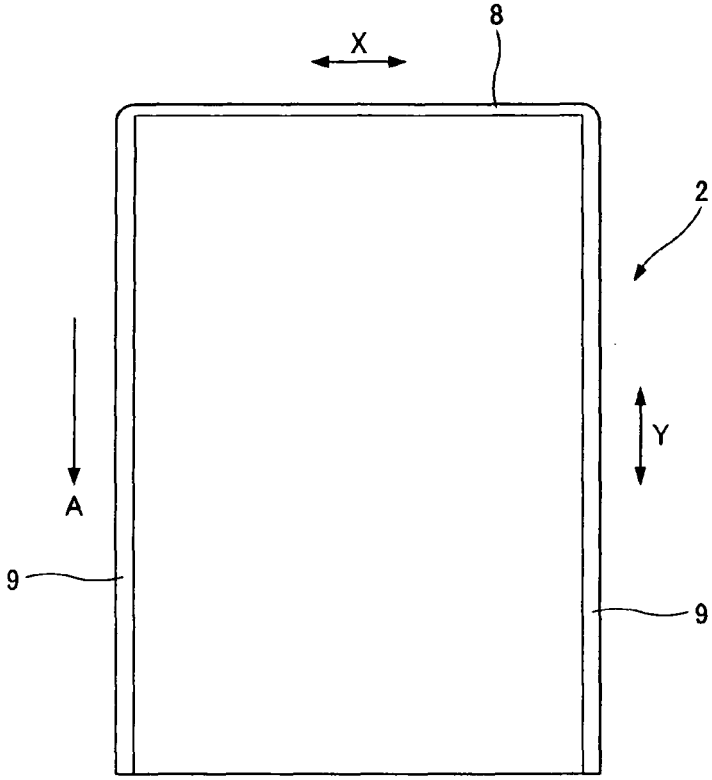
FIG. 2A shows a plan view of the first inner bag.
Figure 2B:
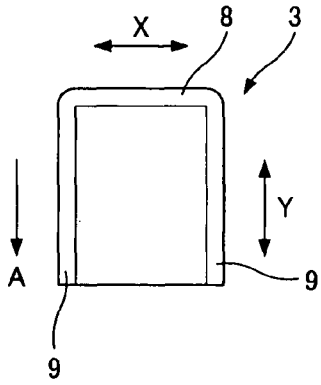
FIG. 2B shows a plan view of the second inner bag.
Figure 3:
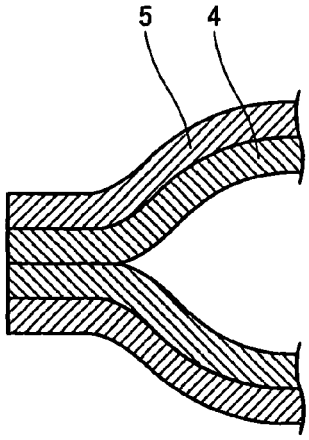
FIG. 3 shows an enlarged section view of the first and the second inner bags.
Figure 4:
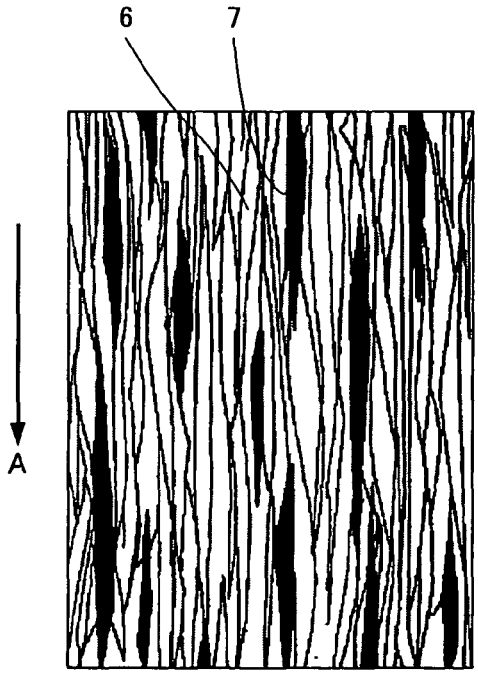
FIG. 4 is an explanatory view showing orientation of resin.
Figure 5:
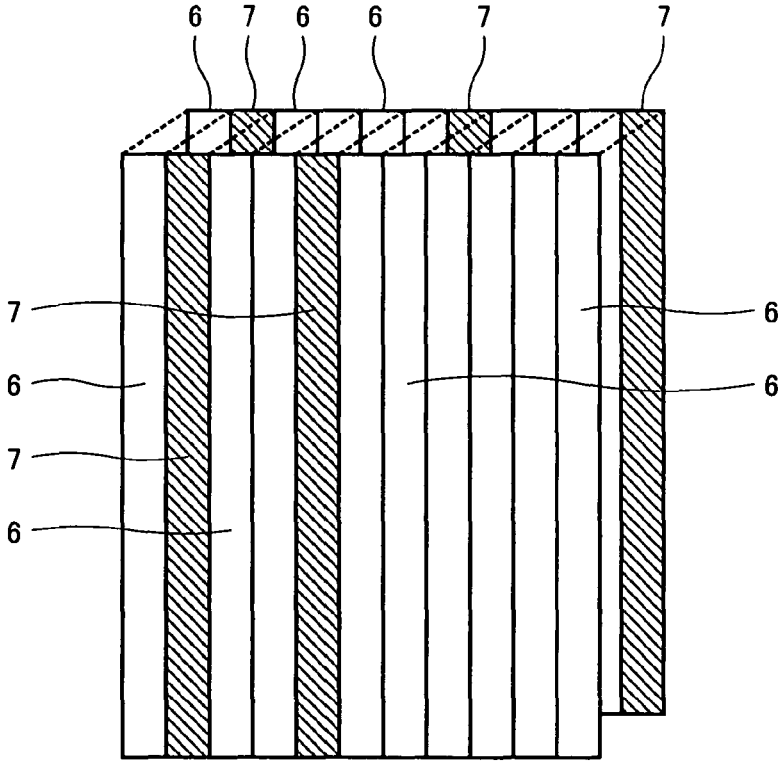
FIG. 5 is an explanatory view showing a combination state of a straight-chain low-density polyethylene resin part and a polybutene-1 resin part in a heat sealed portion.

As is the case with the outer bag 1, the first and the second inner bags 2 and 3 are basically made of a sheet material including an inner layer made of a film material having a low melting point, and an outer layer made of a film material having a higher melting point than that of the inner layer. However, the film material forming the inner layer 4 is made by blending straight-chain low-density polyethylene and polybutene-1, and as the straight-chain low-density polyethylene, those having a density ranging from 0.915 to 0.950 are used, and the ratio of blending straight-chain low-density polyethylene and polybutene-1 is set within a range of 70:30 to 98:2. And it is found that, when the first and the second inner bags 2 and 3 are made by heat sealing with the film material made by blending straight-chain low-density polyethylene and polybutene-1, a difference arises in sealing strength between a heat sealed portion in a direction (X) extending perpendicularly to a film flow direction (direction of an arrow A) and a heat sealed portion in a direction (Y) extending parallel with the film flow direction (direction of the arrow A). In other words, the strength in a width direction along the film flow direction (direction of the arrow A) of the heat sealed portion in the perpendicular direction (X) tends to be smaller than the strength in the width direction extending perpendicularly to the film flow direction (direction of the arrow A) of the heat sealed portion in the parallel direction (Y). This is ascribable to the following facts. The resin as a material for the inner layer 4 of the first and the second inner bags 2 and 3 is a blend of straight-chain low-density polyethylene and polybutene-1. In laminating the inner layer 4 made of a film material as the blend and the outer layer 5 made of nylon or polyethyleneterephthalate, uniaxial orientation appears between straight-chain low-density polyethylene and polybutene-1 under the action of processing speed. In other words, a film is formed while the resin of straight-chain low-density polyethylene and the resin of polybutene-1 are irregularly aligned. This state is shown in FIG. 4 illustrating a resin 6 of straight-chain low-density polyethylene and a resin 7 of polybutene-1. In this manner, since the inner layer 4 has uniaxial orientation, when two film materials each having bilayer structure are overlaid and the peripheries are heat sealed so as to form the four-side sealed inner bags 2 and 3, as shown in FIG. 5, three patterns of facing combinations are provided: a straight-chain low-density polyethylene resin part 6 and a straight-chain low-density polyethylene resin part 6; a polybutene-1 resin part 7 and a polybutene-1 resin part 7; and a straight-chain low-density polyethylene resin part 6 and a polybutene-1 resin part 7. Since the same kinds of resins are heat sealed in the combination of the straight-chain low-density polyethylene resin part 6 and the straight-chain low-density polyethylene resin part 6, and in the combination of the polybutene-1 resin part 7 and the polybutene-1 resin part 7, heat sealing strength is obtained within the characteristics of the resin. On the contrary, in the part where the straight-chain low-density polyethylene resin part 6 and the polybutene-1 resin part 7 oppose to each other, different kinds of resins face each other, so that heat sealing strengths as the respective characteristics are not revealed. Such conditions are mixed in the heat sealing face. Heat seal characteristics according to uniaxial orientation and the above three patterns of combination, and heat sealing direction give the following phenomenon.

Figure 6:
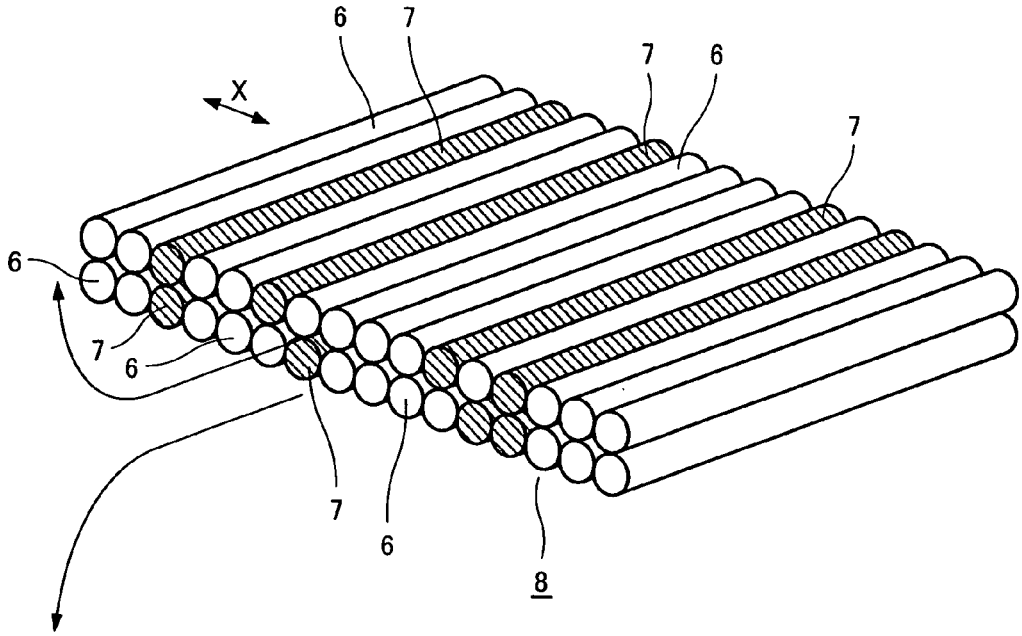
FIG. 6 shows an enlarged view of a relevant part of a sealing edge of the heat sealed portion on a short side.
Figure 7:
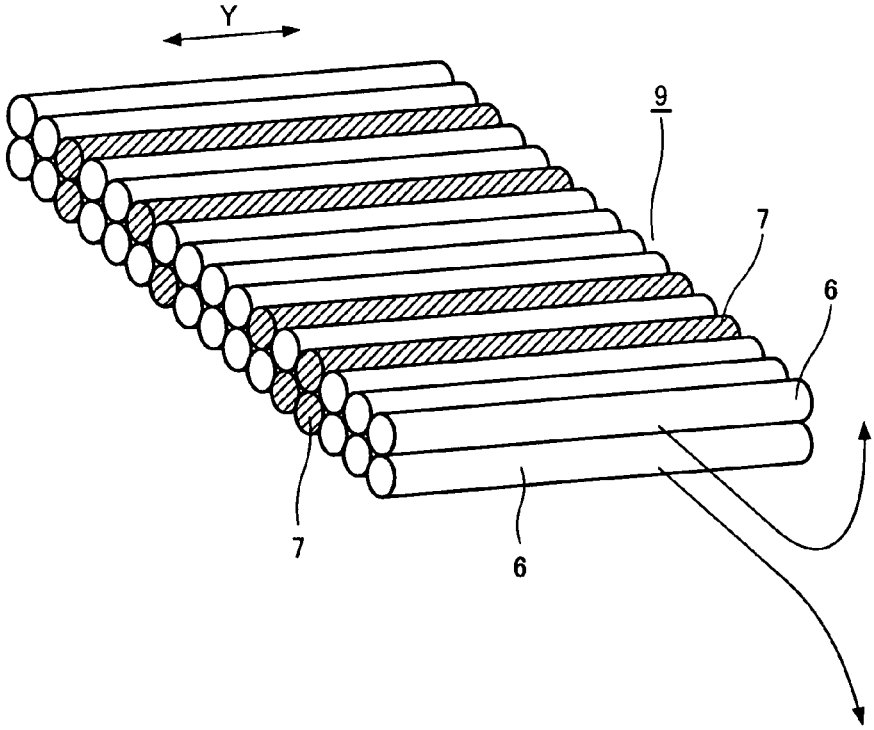
FIG. 7 shows an enlarged view of a relevant part of the sealing edge of the heat sealed portion on a long side.

In the sealing edge in the width direction along the film flow direction (direction of the arrow A) of the heat sealed portion in the direction (X) perpendicular to the film flow direction (direction of the arrow A), the three patterns of combinations appear irregularly (see FIG. 6). On the other hand, in the sealing edge in the width direction extending perpendicularly to the film flow direction (direction of the arrow A) of the heat sealed portion in the direction (Y) parallel to the film flow direction (direction of the arrow A), one of the three patterns of combinations appears (see FIG. 7).

In measurement of heat sealing strength, it is well known that the sealing width of an object is in direct proportion to strength, and the wider the sealing width is, the larger strength the object has. In the sealing edge in the width direction along the film flow direction (direction of the arrow A) of the heat sealed portion in the direction (X) perpendicular to the film flow direction (direction of the arrow A), since three patterns of combinations appear irregularly, the percentage in the sealing width occupied by the combination of straight-chain low-density polyethylene resin part 6 and straight-chain low-density polyethylene resin part 6 and the combination of polybutene-1 resin part 7 and polybutene-1 resin part 7 increasing the strength is less than 100%, and presence of the combination of straight-chain low-density polyethylene resin part 6 and polybutene-1 resin part 7 in the sealing edge decreases the heat sealing strength. In the width direction extending perpendicularly to the film flow direction (direction of the arrow A) of the heat sealed portion in the direction (Y) parallel to the film flow direction (direction of the arrow A), since molecules are oriented uniaxially, there arise three cases of appearance: the combination of the straight-chain low-density polyethylene resin part 6 and the straight-chain low-density polyethylene resin 6 appears in the sealing edge, the combination of the polybutene-1 resin part 7 and the polybutene-1 resin part 7 appears in the sealing edge, and the combination of the straight-chain low-density polyethylene resin part 6 and the polybutene-1 resin part 7 appears in the sealing edge. In comparison with the sealing strength in the width direction along the film flow direction (direction of the arrow A) of the heat sealed portion in the direction (X) perpendicular to the film flow direction (direction of the arrow A), the strength is larger when the combination of the straight-chain low-density polyethylene part 6 and the straight-chain low-density polyethylene part 6 appears or when the combination of the polybutene-1 resin part 7 and the polybutene-1 resin part 7 appears, while the strength is smaller when the combination of the straight-chain low-density polyethylene resin part 6 and the polybutene-1 resin part 7 appears. However, since the sealing strength is determined by the strength of sealing edge, when the combination of the straight-chain low-density polyethylene resin part 6 and the polybutene-1 resin part 7 appears, the strength is small and hence peeling occurs. While, when the combination of the straight-chain low-density polyethylene resin part 6 and the straight-chain low-density polyethylene resin part 6 or the combination of the polybutene-1 resin part 7 and the polybutene-1 resin part 7 appears in the next instant, the sealing strength increases. Totally, the sealing strength in the width direction extending perpendicularly to the film flow direction (direction of the arrow A) of the heat sealed portion in the direction (Y) parallel to the film flow direction (direction of the arrow A) is stronger than that in the width direction along the film flow direction (direction of the arrow A) of the heat sealed portion in the direction (X) perpendicular to the film flow direction (direction of the arrow A). In order to make such characteristics appear, as the straight-chain low-density polyethylene as the material for the inner layer 4, those having a density ranging from 0.915 to 0.950 are preferred, and the ratio of blending straight-chain low-density polyethylene and polybutene-1 is preferably within the range of 70:30 to 98:2 as described above. Outside these ranges, it is difficult to clearly differentiate between the sealing strength in the width direction along the film flow direction (direction of the arrow A) of the heat sealed portion in the direction (X) perpendicular to the film flow direction (direction of the arrow A) and the sealing strength in the width direction extending perpendicularly to the film flow direction (direction of the arrow A) of the heat sealed portion in the direction (Y) parallel to the film flow direction (direction of the arrow A), and to thereby achieve the object of the present invention.

Utilizing the aforementioned nature, in the present embodiment, the two film materials each having a bilayer structure are overlaid and the peripheries are heat sealed to produce the four-side sealed first and the second inner bags 2 and 3 having a rectangular planar shape. In that case, the sealing strength in the width direction along the film flow direction (direction of the arrow A) of the heat sealed portion 8 in the direction (X) perpendicular to the film flow direction (direction of the arrow A), namely on a short side is made smaller than the sealing strength in the width direction extending perpendicularly to the film flow direction (direction of the arrow A) of the heat sealed portion 9 in the direction (Y) parallel to the film flow direction (direction of the arrow A), namely on a long side so that the sealed portion debonds in the width direction of the heat sealed portion 8 on the short side upon increase in inner pressure of the first and the second inner bags 2 and 3. More specifically, of the heat sealed portions 8 opposing to each other on the short side, the widthwise dimension of one of the heat sealed portions 8 on the short side is made smaller than that of the other of the heat sealed portions 8 so that the sealed portion quickly debonds in the width direction of the one of the heat sealed portions 8.

In brief, by forming a part where the heat sealing width is narrow at an appropriate position in the one of the heat sealed portions 8 opposing to each other on the short side, the part having the narrow heat sealing width quickly debonds and provides the opening when the inner pressure is increased by application of external pressure (force of pushing and pressing) on the first and the second inner bags 2 and 3.

Inside the first inner bag 2 manufactured in the manner as described above, a first reaction solution as a base material is introduced via one opening side of the first inner bag 2 and the first inner bag 2 is hermetically sealed, while inside the second inner bag 3, a second reaction solution as a curing agent is introduced via one opening side of the second inner bag 3 and the second inner bag 3 is hermetically sealed. The first inner bag 2 containing the first reaction solution as the base material and the second inner bag 3 containing the second reaction solution as the curing agent are housed in the outer bag 1 from the one opening side thereof. Also, a glass fiber cloth 10 having substantially the same size as the inner dimension of the outer bag 1 is housed in the outer bag 1 so as to go along one face of the first inner bag 2, and the one opening side of the outer bag 1 is hermetically sealed. The outer bag 1 is provided with a sub bag 11 so as to communicate with one end corner part for removing redundant compounds of the first reaction solution and the second reaction solution as contents at the point of use. In the embodiment shown in the drawing, the sub bag 11 is continuously formed so that its one side elongates straight from the long side of the outer bag 1. The communication part between the outer bag 1 and the sub bag 11, namely an inlet of the sub bag 11 is closed by simply sealing, and a sealed portion 12 thereof is configured to debond due to inner pressure from the side of the outer bag 1. An interior of the sub bag 11 is formed with a plurality of partitioning spaces 14 each partitioned by an easily debondable sealed portion 13 as is the case with the sealed portion 12 described above.

Figure 8:
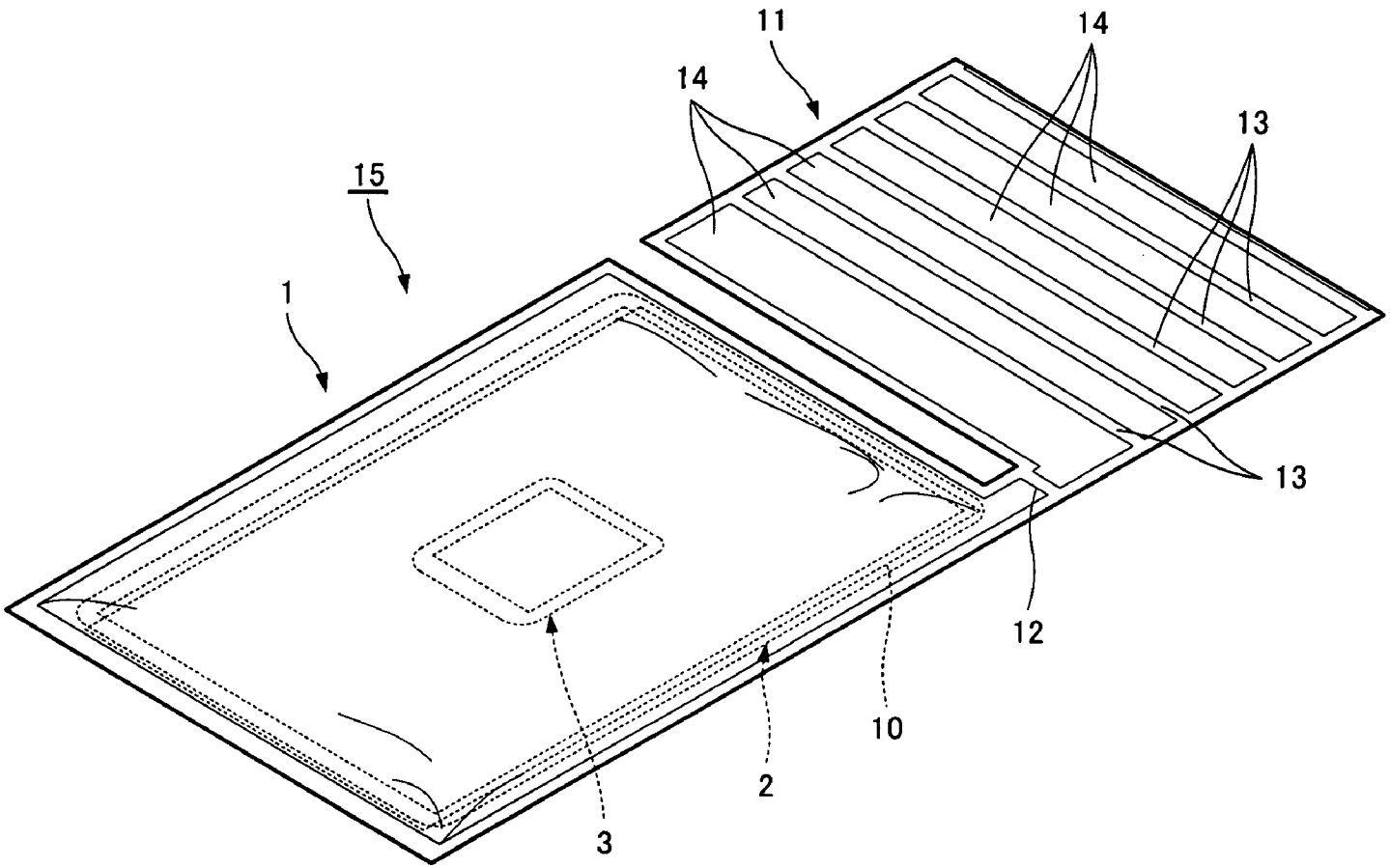
FIG. 8 shows a perspective view of the railway rail supporting pad.
Figure 9:
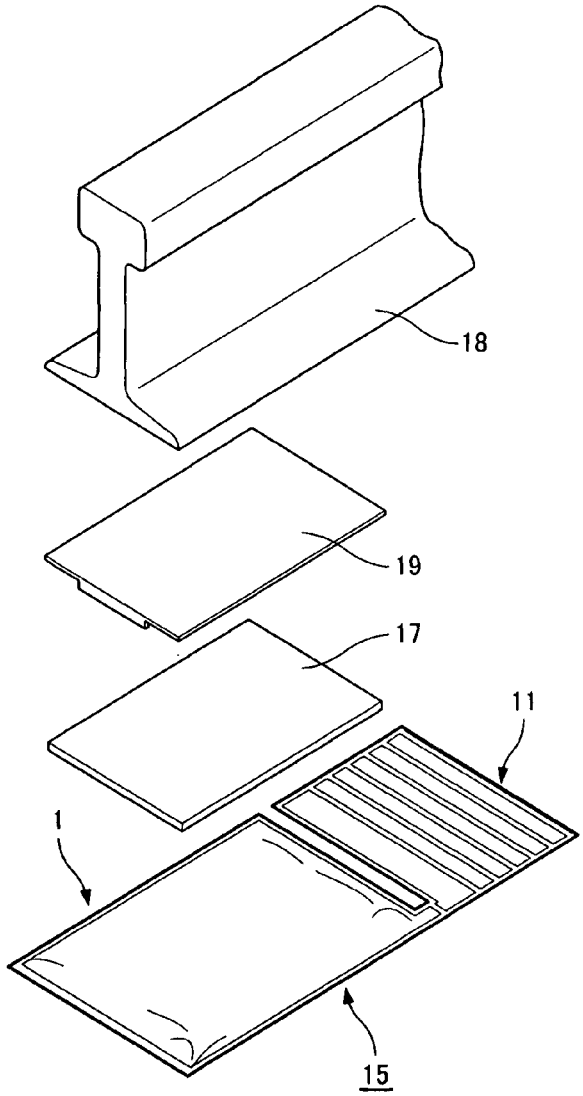
FIG. 9 shows a perspective view of a usage state of the railway rail supporting pad.
Figure 10:
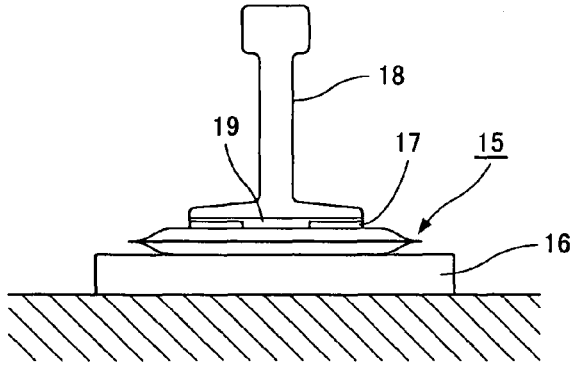
FIG. 10 shows a front view of the usage state of the railway rail supporting pad.

A railway rail supporting pad 15 shown in FIG. 8 formed by the outer bag 1 housing the first inner bag 2 containing the first reaction solution as the base material and the second inner bag 3 containing the second reaction solution as the curing agent is mounted on a rail bearing member 16 in a concrete or wooden sleeper shape shown in FIGS. 9 and 10. On the railway rail supporting pad 15, a rubber pad 17 is mounted for receiving a rail 18 mounted on the rubber pad 17. More specifically, when the railway rail supporting pad 15 is mounted on the rail bearing member 16, external pressure is applied from outside the outer bag 1 of the railway rail supporting pad 15 with the rail 18 floating, thereby causing the parts of the second inner bags 2 and 3 having the narrow heat sealing width to debond to open, so as to mix the first reaction solution and the second reaction solution as the contents of the outer bag 1 therein, whereby the railway rail supporting pad 15 is mounted on the rail bearing member 16. Then, on the railway rail supporting pad 15, the rubber pad 17 is mounted, and then the rail 18 is brought down on the rubber pad 17 via a U-shaped iron plate 19 to have a predetermined height, and then the rail 18 is fastened. The U-shaped iron plat 19 is set on the rubber pad 17 so as to go along the long side of the railway rail supporting pad 15. As the rail 18 is mounted on the U-shaped iron plate 19, the railway rail supporting pad 15 is strongly pushed, and the redundant compounds of the first reaction solution and the second reaction solution tend to flow into the sub bag 11 as the surplus. At this time, the sealed portion 12 opens due to pressure exerted on the sealed portion 12 by the redundant compounds of the first reaction solution and the second reaction solution, and the redundant compounds of the first reaction solution and the second reaction solution flow into the partitioning space 14 located closest to the sealed portion 12. Then the sealed portion 13 between this partitioning space 14 and an adjacent next partitioning space 14 opens, and the redundant compounds of the first reaction solution and the second reaction solution flow into the next partitioning space 14. In this manner, the redundant compounds of the first reaction solution and the second reaction solution flow into a plurality of partitioning spaces 14, thereby the redundant compounds of the first reaction solution and the second reaction solution are removed from the outer bag 1. Thereafter a path between the outer bag 1 and the sub bag 11 is closed appropriately by a clip or the like, and after confirming completion of curing of the compounds of the first reaction solution and the second reaction solution in the railway rail supporting pad 15, the sub bag 11 is separated from the outer bag 1 with scissors or a cutter. In other words, the thickness of a cured product of the compounds of the first reaction solution and the second reaction solution in the railway rail supporting pad 15 adjusts the adhesivity between the rail bearing member 16 and the rail 18 via the rubber pad 17, and the redundant compounds of the first reaction solution and the second reaction solution are contained in the sub bag 11 and separated from the outer bag 1. The compounds of the first reaction solution and the second reaction solution wrap around the glass fiber cloth 10, so as to enhance the strength of the cured product of the compounds.

Concrete examples of the first reaction solution as the base material contained in the first inner bag 2 include compounds having an epoxy group, compounds having an isocyanate group, compounds of unsaturated diacid (glycol and maleic anhydride, fumaric acid, and the like), compounds such as acrylic acid or acrylate, compounds having a silanol group, and compounds having an amino group. Concrete examples of the second reaction solution as the curing agent contained in the second inner bag 3 include compounds such as polyamine, acid anhydride and polyphenol, compounds having a hydroxyl group, compounds such as peroxide, compounds having an isocyanate group, and compounds such as formaldehyde. The second reaction solution suited for the first reaction solution contained in the first inner bag 2 is contained in the second inner bag 3, and for example, when a compound having an epoxy group is used as the first reaction solution contained in the first inner bag 2, a compound of polyamine, acid anhydride, polyphenol or the like is used as the second reaction solution contained in the second inner bag 3; when a compound having the isocyanate group is used as the first reaction solution, a compound having the hydroxyl group is used as the second reaction solution; when a compound of unsaturated diacid (glycol and maleic anhydride, fumaric acid, or the like) or a compound of acrylic acid or acrylate is used as the first reaction solution, a compound of peroxide or the like is used as the second reaction solution; when a compound having the silanol group is used as the first reaction solution, a compound having the isocyanate group is used as the second reaction solution; and when a compound having the amino group is used as the first reaction solution, a compound of formaldehyde or the like is used as the second reaction solution. A combination of the first reaction solution as the base material contained in the first inner bag 2 and the second reaction solution as the curing agent contained in the second inner bag 3 is appropriately selected. In brief, the combination may be such that the first reaction solution as the base material and the second reaction solution as the curing agent are mixed together to turn into resin and cure.

A quantity ratio between the first reaction solution as the base material and the second reaction solution as the curing agent differs depending on the kind of the reaction solution, and the sizes of the first inner bag 2 and the second inner bag 3 are determined in correspondence with the used quantity.

The sealed portions 12 and 13 are sealed with a sealing agent not spontaneously resolve by the contained compounds of the first reaction solution and the second reaction solution, and such a sealing agent is appropriately selected from synthetic rubber adhesive, natural rubber adhesive, acrylic adhesive, heat sealing agent, hot melt resin and the like. Instead of using such a sealing agent, an easily debondable tape may be used to simplify the sealing.

Figure 11:
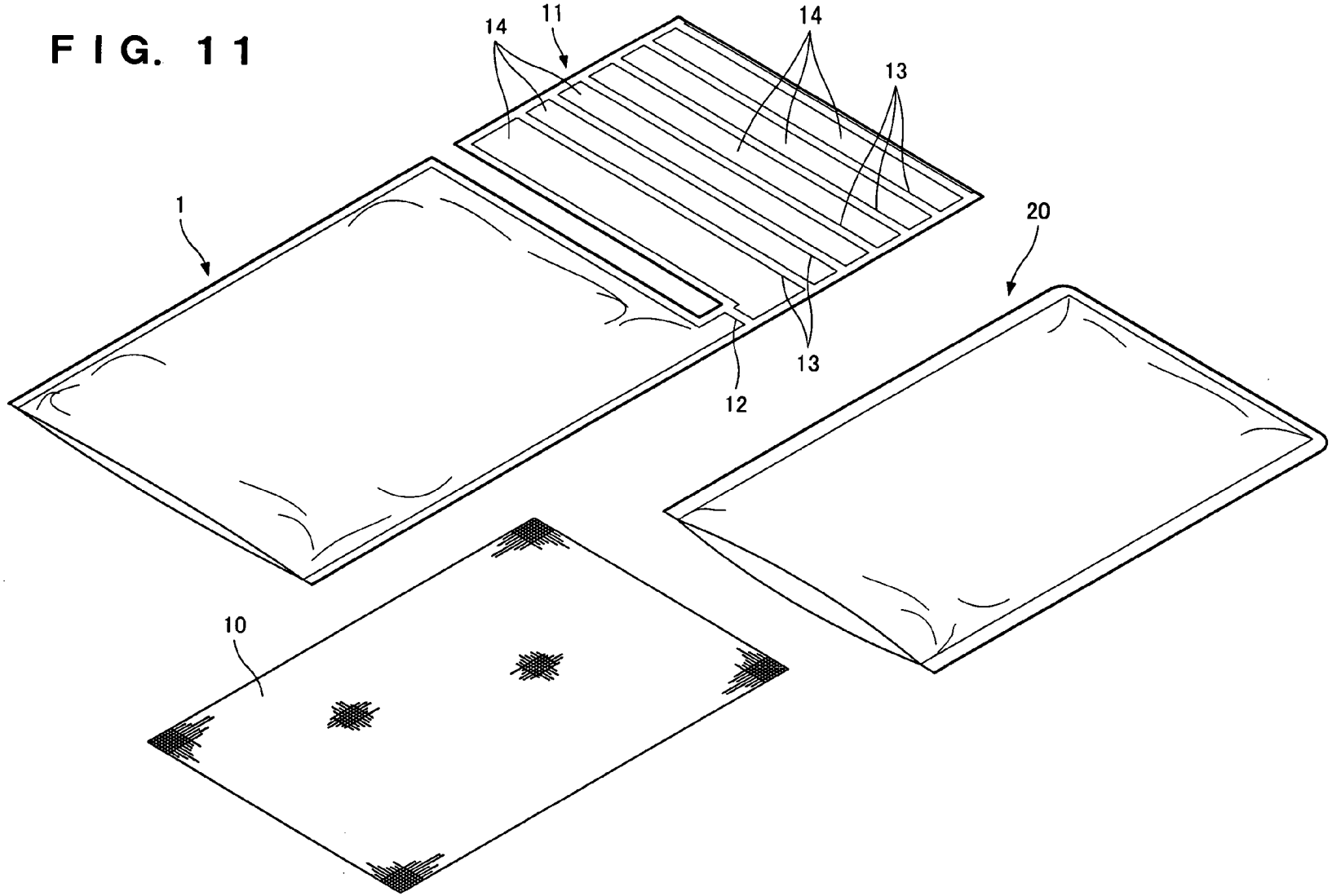
FIG. 11 shows exploded perspective views of an outer bag, an inner bag, and a glass fiber cloth constituting a railway rail supporting pad in a second embodiment of the present invention.

Next, A second embodiment shown in FIG. 11 will be explained. In the first embodiment, the first inner bag 2 containing the first reaction solution as the base material and the second inner bag 3 containing the second reaction solution as the curing agent are housed in the outer bag 1, while in the second embodiment, the first reaction solution as the base material or the second reaction solution as the curing agent is directly contained in the outer bag 1, and only one inner bag 20 containing the second reaction solution as the curing agent or the first reaction solution as the base material is housed in the outer bag 1. The inner bag 20 used in the second embodiment is also openable due to external pressure as in the case with the first and the second inner bags 2 and 3 of the first embodiment. Other configurations are the same as those of the first embodiment.

The two embodiments have been described in the above, and it is also possible to house an inner bag containing a curing accelerator in the outer bag 1 as necessary. Also, this inner bag is configured to be openable due to external pressure as is the case with the first and the second inner bags 2 and 3 of the first embodiment. In the first embodiment, the curing accelerator may be directly contained in the outer bag 1.

Further, in order to open the inner bag due to external pressure, a method of making a part of the sealed portion closing the inner bag smaller in strength and making the part open due to external pressure can be exemplified, as well as the method of using straight-chain low-density polyethylene and polybutene-1 as described above, and thus the method is not limited to using straight-chain low-density polyethylene and polybutene-1.

Figure 12:
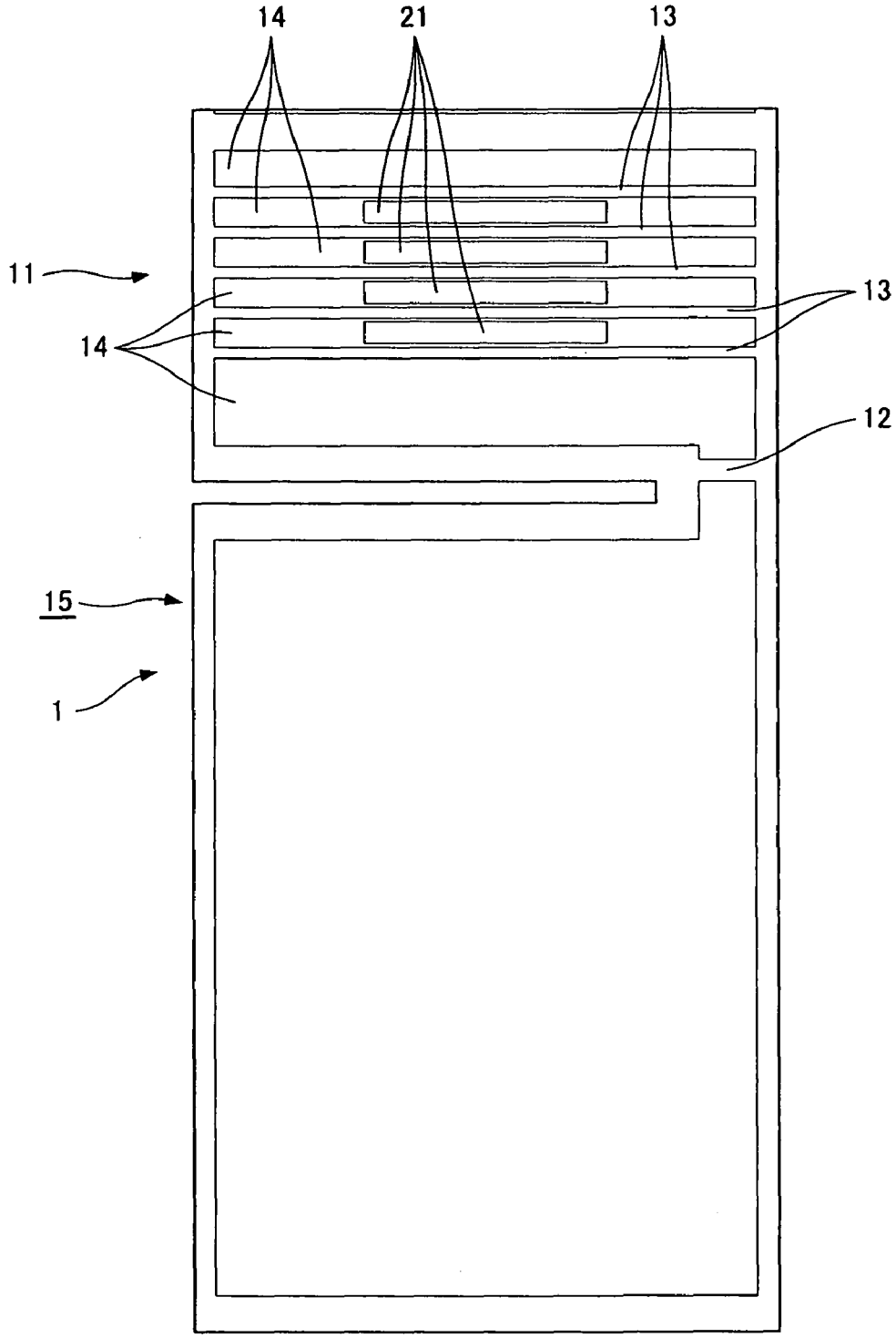
FIG. 12 shows a plan view of a railway rail supporting pad in a third embodiment of the present invention.

Next, explanation will be made on a third embodiment shown in FIG. 12. According to the third embodiment, in a center part of the partitioning space 14 formed by the sealed portion 13 and the sealed portion 13 of the sub bag 11 as illustrated in the first embodiment, a sealed portion 21 simply sealed as is the case with the sealed portion 13 is formed, whereby inner pressure by the redundant compounds of the first reaction solution and the second reaction solution from the outer bag 1 gradually opens the sealed portion 13 and the sealed portion 21 from the center part thereof, to allow the redundant compounds of the first reaction solution and the second reaction solution to flow into the partitioning space 14.

Figure 13:
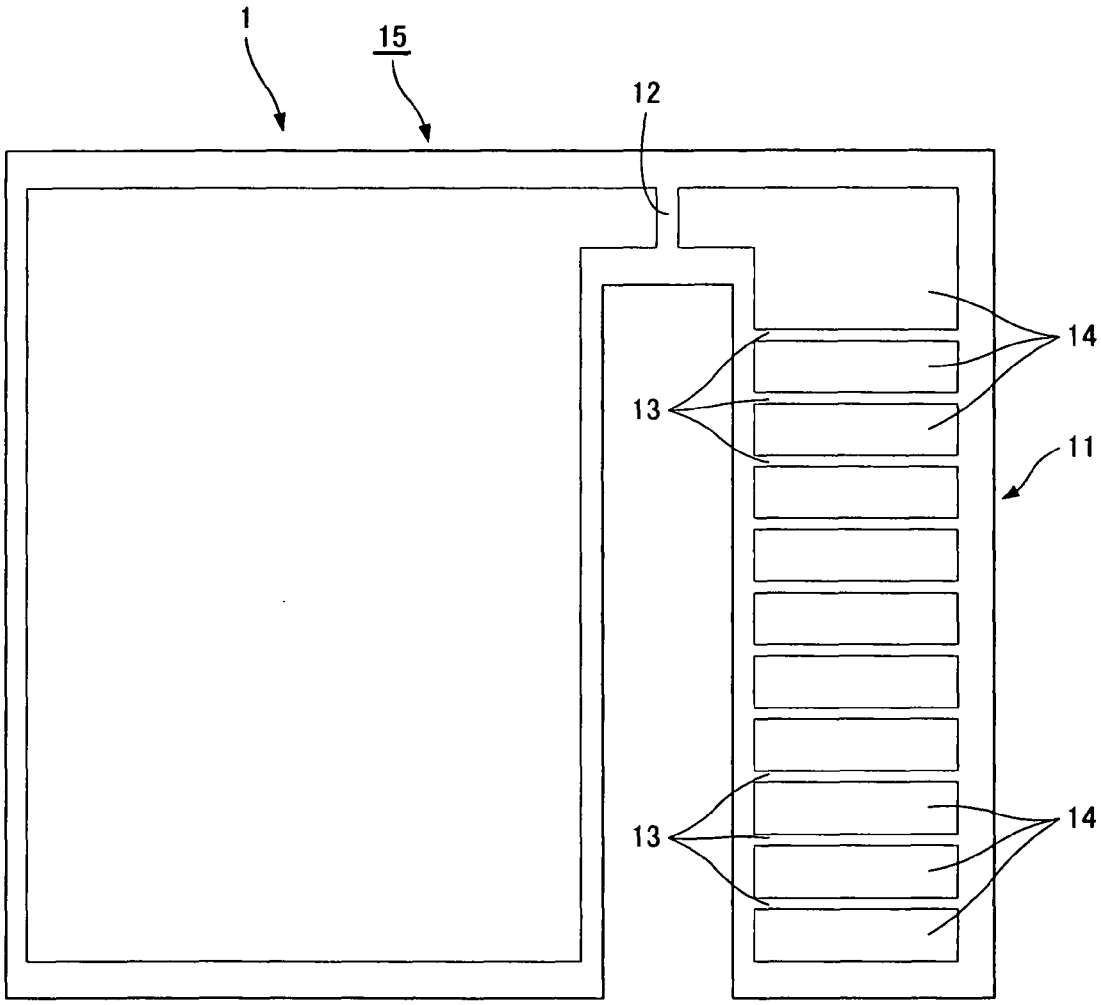
FIG. 13 shows a plan view of a railway rail supporting pad in a fourth embodiment of the present invention.

Next, explanation will be made on a fourth embodiment shown in FIG. 13. According to the fourth embodiment, the sub bag 11 is arranged so as to project from the outer bag 1 and to be in parallel with the long side of the outer bag 1. Also in this fourth embodiment, the interior of the sub bag 11 is formed with a plurality of partitioning spaces 14 by the sealed portion 13. As is the case in the third embodiment, in the center part of the partitioning space 14 formed by the sealed portion 13 and the sealed portion 13 of the sub bag 11, a simply sealed portion 21 may be formed.

Figure 14:
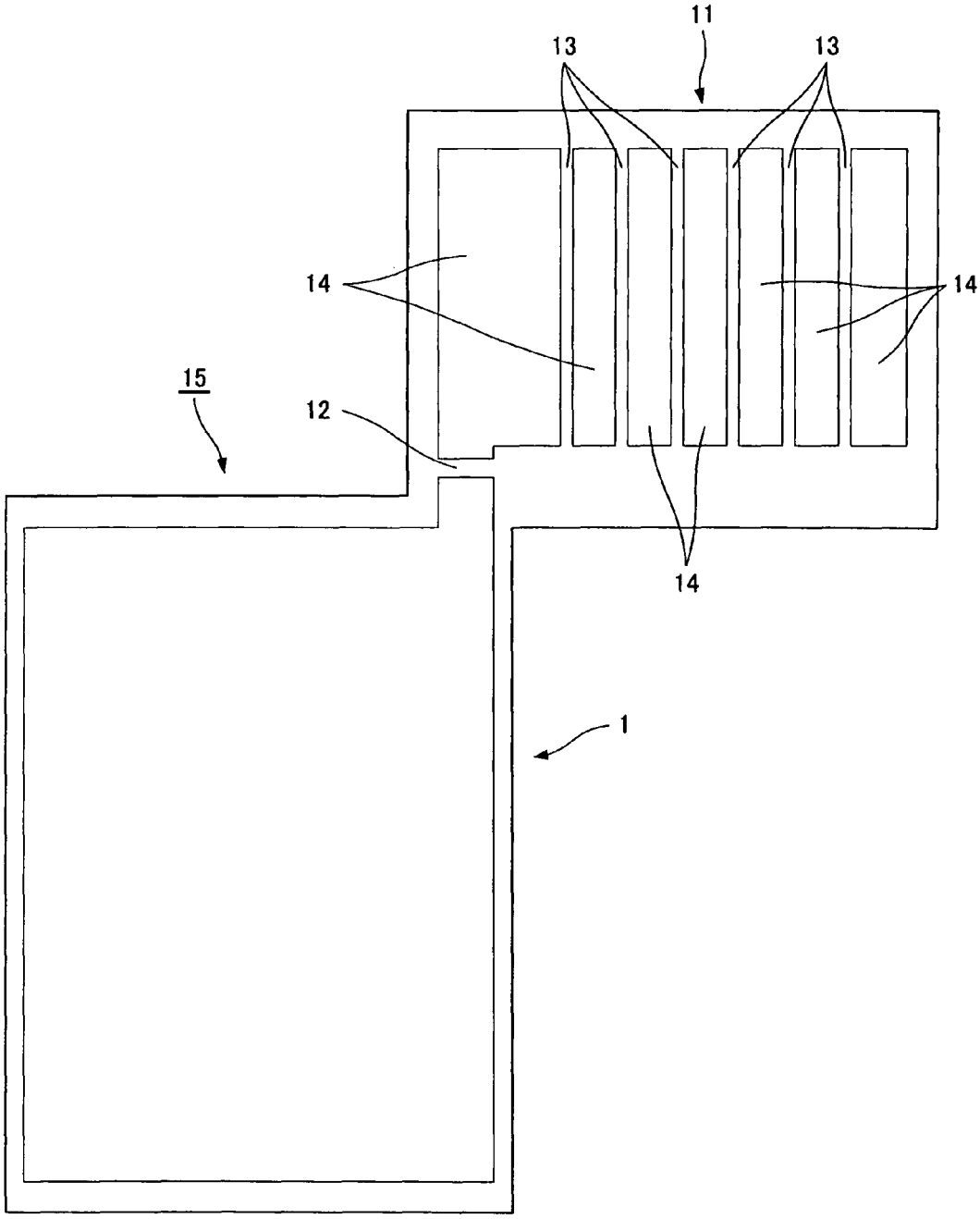
FIG. 14 shows a plan view of a railway rail supporting pad in a fifth embodiment of the present invention.

Next, explanation will be made on a fifth embodiment shown in FIG. 14. According to the fifth embodiment, the sub bag 11 is arranged to project perpendicularly from one end corner part of the outer bag 1. Also in this fifth embodiment, the interior of the sub bag 11 is formed with a plurality of partitioning spaces 14 by the sealed portion 13. As is the case in the third embodiment, in the center part of the partitioning space 14 formed by the sealed portion 13 and the sealed portion 13, a simply sealed portion 21 may be formed.

Also in these forth and fifth embodiments, as is the case in the third embodiment, in the center part of the partitioning space 14, a simply sealed portion 21 may be formed. In the forth and fifth embodiments, after the redundant compounds of the first reaction solution and the second reaction solution flow into the plurality of partitioning spaces 14 and the redundant compounds of the first reaction solution and the second reaction solution are removed from the outer bag 1, the path between the outer bag 1 and the sub bag 11 is closed appropriately by the clip or the like, and after confirming completion of curing the compounds of the first reaction solution and the second reaction solution in the railway rail supporting pad 15, the sub bag 11 is separated from the outer bag 1 with the scissors or the cutter.

Further, in the third to fifth embodiments, as is the case with the second embodiment, the first reaction solution as the base material or the second reaction solution as the curing agent may be directly contained in the outer bag 1, and only one inner bag containing the second reaction solution as the curing agent or the first reaction solution as the base material may be housed in the outer bag 1.

What is claimed is:

1. A railway rail supporting pad to be interposed between a rail bearing member and a rail, which fills a gap between the rail bearing member and the rail with the rail being placed at a height adjusted disposition and compounds of two types of reaction solutions cured in an outer bag, the railway rail supporting pad comprising:

the outer bag made of a synthetic resin sheet, the outer bag containing one of a first reaction solution as a base material and a second reaction solution as a curing agent;

an inner bag made of a synthetic resin sheet so that at least a part thereof opens due to external pressure, the inner bag being provided inside the outer bag and containing one of the second reaction solution as the curing agent and the first reaction solution as the base material;

a sub bag that is separable from the outer bag in a communicative manner;

a first sealed portion provided at a communication part between the outer bag and the sub bag; and a second sealed portion partitioning the sub bag into a plurality of partitioning spaces, wherein the external pressure is applied to the outer bag from outside, the inner bag is opened by the external pressure from outside, the first and second reaction solutions are mixed in the outer bag, and redundant compounds of the reaction solutions flow into the sub bag while opening the first sealing portion, further redundant compounds cause the second seal portion to open step-by-step and flow into the partitioning spaces step-by-step, and the thickness of the curing agent of the reaction solutions remaining in the outer bag is adjusted with a plurality of steps, wherein after the reaction solutions flow into the sub bag, and the partitioning spaces in the sub bag adjacent to the outer bag are filled with the reaction solutions, in a case that the redundant compounds flow even more, the redundant compounds open the second sealed portion step-by-step and flow into the partitioning spaces step-by-step, thereafter, the communication part between the outer bag and the sub bag is closed from outside, after confirming completion of curing of the compounds of the reaction solutions, the communication part between the outer bag and the sub bag is cut away.

2. The railway rail supporting pad according to claim 1, wherein the outer bag is provided with the sub bag so as to communicate with one end corner part of the outer bag.

3. A railway rail supporting pad to be interposed between a rail bearing member and a rail, which fills a gap between the rail bearing member and the rail with the rail being placed at a height adjusted disposition and compounds of two types of reaction solutions cured in an outer bag, the railway rail supporting pad comprising:

the outer bag made of a synthetic resin sheet;

a first inner bag and a second inner bag each made of a synthetic resin sheet so that at least a part thereof opens due to external pressure, the inner bags being provided inside the outer bag, the first inner bag containing a first reaction solution as a base material, the second inner bag containing a second reaction solution as a curing agent;

a sub bag that is separable from the outer bag in a communicative manner;

a first sealed portion provided at a communication part between the outer bag and the sub bag; and a second sealed portion partitioning the sub bag into a plurality of partitioning spaces, wherein the external pressure is applied to the outer bag from outside, the inner bag is opened by the external pressure from outside, the first and second reaction solutions are mixed in the outer bag, and redundant compounds of the reaction solutions flow into the sub bag while opening the first sealing portion, further redundant compounds cause the second seal portion to open step-by-step and flow into the partitioning spaces step-by-step, and the thickness of the curing agent of the reaction solutions remaining in the outer bag is adjusted with a plurality of steps, wherein after the reaction solutions flow into the sub bag, and the partitioning spaces in the sub bag adjacent to the outer bag are filled with the reaction solutions, in a case that the redundant compounds flow even more, the redundant compounds open the second sealed portion step-by-step and flow into the partitioning spaces step-by-step, thereafter, the communication part between the outer bag and the sub bag is closed from outside, after confirming completion of curing of the compounds of the reaction solutions, the communication part between the outer bag and the sub bag is cut away.

4. The railway rail supporting pad according to claim 3 wherein the outer bag is provided with the sub bag so as to communicate with one end corner part of the outer bag.

* * * * *